US008684361B2

(12) United States Patent
Henson et al.

(10) Patent No.: US 8,684,361 B2
(45) Date of Patent: Apr. 1, 2014

(54) TARGET SYSTEM

(75) Inventors: Blaine Henson, Provo, UT (US); Jeffrey Turner, Orem, UT (US)

(73) Assignee: Action Target Inc., Provo, UT (US)

( * ) Notice: Subject to any disclaimer, the term of this patent is extended or adjusted under 35 U.S.C. 154(b) by 77 days.

(21) Appl. No.: 13/350,365

(22) Filed: Jan. 13, 2012

(65) Prior Publication Data

US 2012/0193872 A1 Aug. 2, 2012

Related U.S. Application Data

(60) Provisional application No. 61/433,513, filed on Jan. 17, 2011.

(51) Int. Cl.
*F41J 7/00* (2006.01)

(52) U.S. Cl.
USPC ..... 273/406; 273/392; 273/389

(58) Field of Classification Search
USPC ..... 273/403–410, 389–392
See application file for complete search history.

(56) References Cited

U.S. PATENT DOCUMENTS

| | | | | |
|---|---|---|---|---|
| 429,942 | A | 6/1890 | McBride | |
| 570,820 | A | 11/1896 | Scratton | |
| 631,175 | A | 8/1899 | Parnall | |
| 840,610 | A | 1/1907 | Easdale | |
| 879,670 | A | 2/1908 | Petry | |
| 937,733 | A | 10/1909 | Worrell | |
| 950,101 | A | 2/1910 | Green | |
| 960,085 | A | 5/1910 | Giles | |
| 960,892 | A | 6/1910 | Gates | |
| 1,207,456 | A | 12/1916 | Whelan | |
| 1,267,722 | A * | 5/1918 | Walter | 273/391 |
| 1,348,283 | A | 8/1920 | Koehl | |
| 1,424,632 | A | 8/1922 | Fenton | |
| 1,540,802 | A | 6/1925 | Ordway | |
| 1,543,605 | A | 6/1925 | Gavard | |
| 1,559,171 | A | 10/1925 | Knowles | |
| 1,657,931 | A | 7/1926 | Krantz | |
| 1,640,954 | A | 8/1927 | Mach | |
| 1,738,874 | A | 12/1929 | Domingo | |
| 1,831,289 | A | 11/1931 | Dally | |
| 2,048,155 | A | 1/1935 | Armantrout | |
| 2,008,359 | A | 7/1935 | Lamb | |

(Continued)

FOREIGN PATENT DOCUMENTS

| | | |
|---|---|---|
| CA | 2100631 | 2/1994 |
| GB | 2136932 | 9/1984 |
| GB | 2 187 270 | 9/1987 |

OTHER PUBLICATIONS

Caswell International Corp., Product Literature, Copyright 2002.

(Continued)

*Primary Examiner* — Mark Graham
(74) *Attorney, Agent, or Firm* — Bateman IP

(57) ABSTRACT

A target system includes a blocking plate with one or more openings through which bullets are fired and one or more targets for being struck by the bullets disposed behind the blocking plate and generally in line with the one or more openings. The target system may include a hinge mechanism which limits the range of movement of the target after it has been struck by a projectile. The hinge mechanism may also provide for tool less attachment and removal of the targets from the hinge mechanism.

19 Claims, 8 Drawing Sheets

(56) References Cited

U.S. PATENT DOCUMENTS 2,039,552 A 5/1936 Reynolds
2,085,933 A 7/1937 Vaughan
2,104,171 A 1/1938 Schwerin
2,113,719 A * 4/1938 Creswell ..... 273/390
2,179,471 A 11/1939 Lee
2,284,510 A 5/1942 Cates
2,290,297 A 7/1942 Smith
2,344,829 A 3/1944 McAvoy
2,372,111 A 3/1945 Norberg
2,538,118 A 6/1949 Miller
2,494,210 A 1/1950 Robinson
2,535,280 A 12/1950 Gartrell
2,586,958 A 2/1952 Keller
2,587,042 A 2/1952 Haiselup
2,613,934 A 10/1952 Tabler
2,706,634 A 4/1955 Van Valkenburg
2,777,695 A * 1/1957 Cohn ..... 273/386
2,809,836 A 10/1957 Musser
2,819,903 A 1/1958 Saunders
2,838,309 A 6/1958 Merz et al.
2,905,469 A 9/1959 Taylor
2,957,694 A * 10/1960 Barber et al. ..... 273/388
3,014,725 A 12/1961 Lewis
3,032,808 A 5/1962 Fleming
3,064,976 A 11/1962 Kuhn
3,087,701 A 4/1963 Wallace
3,103,362 A 9/1963 Elofson
3,113,773 A 12/1963 Ripepe
3,140,874 A 7/1964 Jensen et al.
3,348,843 A 10/1967 Stanley
3,363,900 A 1/1968 Cadle
3,385,405 A 5/1968 Cullen
3,392,980 A 7/1968 Ortega
3,422,538 A 1/1969 Panissidi
3,471,153 A 10/1969 Baumler
3,510,133 A 5/1970 Gretzky
3,515,388 A 6/1970 Zachmeier
3,540,729 A 11/1970 Rahberger
3,601,353 A 8/1971 Dale
3,614,102 A 10/1971 Nikoden, Sr.
3,650,179 A 3/1972 Stenger
3,720,138 A 3/1973 Van Scoy
3,802,098 A 4/1974 Sampson et al.
3,814,429 A * 6/1974 Lienhard ..... 273/368
3,889,466 A 6/1975 Castela et al.
3,914,879 A 10/1975 Taylor, III
3,992,007 A 11/1976 Seeman
4,072,313 A 2/1978 Murso et al.
4,076,247 A 2/1978 Kim et al.
4,084,299 A 4/1978 Noda
4,086,711 A 5/1978 Gammarino et al.
4,177,835 A 12/1979 Paley
4,182,094 A 1/1980 Lieder et al.
4,184,802 A 1/1980 Cook et al.
4,205,847 A 6/1980 Steiger et al.
4,228,569 A 10/1980 Snyder
4,232,867 A 11/1980 Tate, Sr.
4,288,080 A 9/1981 Laporte et al.
4,294,452 A 10/1981 Schlotter et al.
4,340,370 A 7/1982 Marshall et al.
4,361,330 A 11/1982 Scharer
4,395,045 A 7/1983 Baer
4,440,399 A 4/1984 Smith
4,501,427 A 2/1985 Payne
4,506,416 A 3/1985 Ohminato et al.
4,540,182 A 9/1985 Clement
4,546,984 A 10/1985 Towle et al.
4,614,345 A 9/1986 Doughty
4,657,261 A 4/1987 Saunders
4,691,925 A 9/1987 Scholem
4,706,963 A 11/1987 Geuss
4,726,593 A 2/1988 Wade
4,739,996 A 4/1988 Vedder
4,743,032 A 5/1988 Summers et al.
4,807,888 A 2/1989 Pidde
4,844,476 A 7/1989 Becker
4,890,847 A 1/1990 Cartee et al.
4,898,391 A 2/1990 Kelly et al.
4,911,453 A 3/1990 Essex et al.
4,913,389 A 4/1990 McCracken
4,979,752 A 12/1990 Fosseen
5,054,723 A 10/1991 Arnold
5,145,133 A 9/1992 France
5,163,689 A 11/1992 Bateman
5,213,336 A 5/1993 Bateman
5,232,227 A 8/1993 Bateman
5,240,258 A 8/1993 Bateman
5,242,172 A 9/1993 Bateman
5,257,790 A * 11/1993 Meadows ..... 273/389
5,263,721 A 11/1993 Lowrance
5,277,432 A 1/1994 Bateman
5,316,479 A 5/1994 Wong et al.
5,324,043 A 6/1994 Estrella
5,346,226 A 9/1994 Block
5,350,180 A 9/1994 Acock
5,352,170 A 10/1994 Condo et al.
5,361,455 A 11/1994 Kiefer
5,400,692 A 3/1995 Bateman
5,433,451 A 7/1995 De Vries
5,535,662 A 7/1996 Bateman
5,598,996 A 2/1997 Rath
5,605,335 A 2/1997 Simpson
5,618,044 A 4/1997 Bateman
5,621,950 A 4/1997 White
5,636,995 A 6/1997 Sharpe, III et al.
5,641,288 A 6/1997 Zaenglein, Jr.
5,648,794 A 7/1997 Jelsma et al.
5,649,706 A 7/1997 Treat, Jr. et al.
5,676,378 A 10/1997 West
5,695,196 A 12/1997 Yanosky
5,765,832 A 6/1998 Huff
5,768,972 A 6/1998 Christenson et al.
5,788,245 A * 8/1998 Hada ..... 273/392
5,802,460 A 9/1998 Parvulescu et al.
5,811,718 A 9/1998 Bateman
5,822,936 A 10/1998 Bateman
5,829,753 A 11/1998 Wiser
5,865,439 A 2/1999 Marcuson
5,906,552 A 5/1999 Padilla
5,907,930 A 6/1999 Ricco
5,934,678 A 8/1999 Theissen et al.
5,947,477 A 9/1999 Turnipseed
5,950,283 A 9/1999 Sato
5,951,016 A 9/1999 Bateman
5,963,624 A 10/1999 Pope
5,967,523 A 10/1999 Brownlee
5,988,645 A 11/1999 Downing
6,018,847 A 2/2000 Lu
6,109,614 A 8/2000 Ciarcia
6,223,029 B1 4/2001 Stenman et al.
6,230,214 B1 5/2001 Liukkonen et al.
6,283,756 B1 9/2001 Danckwerth et al.
6,289,213 B1 9/2001 Flint et al.
6,308,062 B1 10/2001 Chien et al.
6,311,980 B1 11/2001 Sovine et al.
6,322,444 B1 11/2001 Matsui et al.
6,325,376 B1 12/2001 Elliott et al.
6,328,651 B1 12/2001 Lebensfeld et al.
6,332,243 B1 12/2001 Kim
6,378,870 B1 4/2002 Sovine
6,398,215 B1 6/2002 Carroll
6,463,299 B1 10/2002 Macor
6,478,301 B1 11/2002 Witmeyer
6,484,990 B1 11/2002 Marshall
6,502,820 B2 1/2003 Slifko
6,533,280 B1 3/2003 Sovine et al.
6,543,778 B2 4/2003 Baker
6,575,753 B2 6/2003 Rosa et al.
6,588,759 B1 7/2003 Bateman
6,679,795 B2 1/2004 Ouimette et al.
6,718,596 B2 4/2004 Kohlstrand et al.
6,728,546 B1 4/2004 Peterson et al.
RE38,540 E 6/2004 Bateman
6,761,357 B2 7/2004 Witt

(56) References Cited

U.S. PATENT DOCUMENTS

| | | | | |
|---|---|---|---|---|
| 6,776,418 | B1 | 8/2004 | Sovine et al. | |
| 6,808,177 | B2 | 10/2004 | Dehart | |
| 6,808,178 | B1 | 10/2004 | Sovine | |
| 6,896,267 | B1 | 5/2005 | Le Anna | |
| 6,975,859 | B1 | 12/2005 | Lambert et al. | |
| 6,994,347 | B2 | 2/2006 | Tessel et al. | |
| 6,994,348 | B2 | 2/2006 | Lambert et al. | |
| 6,994,349 | B2 | 2/2006 | Lambert et al. | |
| 7,128,321 | B1 * | 10/2006 | Brown | 273/392 |
| 7,134,977 | B2 | 11/2006 | Campbell et al. | |
| 7,140,615 | B1 | 11/2006 | Sovine et al. | |
| 7,175,181 | B1 | 2/2007 | Bateman et al. | |
| 7,194,944 | B2 | 3/2007 | Lambert et al. | |
| 7,201,376 | B2 | 4/2007 | Kuosa | |
| 7,219,897 | B2 | 5/2007 | Sovine et al. | |
| 7,234,890 | B1 | 6/2007 | Marshall et al. | |
| 7,264,246 | B2 | 9/2007 | Sovine et al. | |
| 7,275,748 | B2 | 10/2007 | Lambert et al. | |
| 7,303,192 | B2 | 12/2007 | Marshall et al. | |
| 7,306,230 | B2 | 12/2007 | Lambert et al. | |
| 7,322,771 | B1 | 1/2008 | Marshall et al. | |
| 7,427,069 | B2 | 9/2008 | Bateman et al. | |
| 7,431,302 | B2 | 10/2008 | Bassett et al. | |
| 7,469,903 | B2 | 12/2008 | Marshall et al. | |
| 7,503,250 | B2 | 3/2009 | Lambert et al. | |
| 7,556,268 | B2 | 7/2009 | Bateman et al. | |
| 7,653,979 | B2 | 2/2010 | Bateman et al. | |
| 7,775,526 | B1 | 8/2010 | Lambert et al. | |
| 7,793,937 | B2 | 9/2010 | Bateman et al. | |
| 2005/0022658 | A1 | 2/2005 | Bateman | |
| 2006/0234069 | A1 | 10/2006 | Sovine et al. | |
| 2006/0240388 | A1 | 10/2006 | Marshall et al. | |
| 2006/0240391 | A1 | 10/2006 | Sovine et al. | |
| 2006/0290063 | A1 | 12/2006 | Hagar | |
| 2006/0290064 | A1 | 12/2006 | Hagar | |
| 2007/0072537 | A1 | 3/2007 | Bateman et al. | |
| 2007/0102883 | A1 | 5/2007 | Parks et al. | |
| 2008/0185786 | A1 * | 8/2008 | Loveland et al. | 273/391 |
| 2008/0216645 | A1 | 9/2008 | Jacobsen et al. | |
| 2008/0277876 | A1 * | 11/2008 | Riley | 273/388 |
| 2009/0179382 | A1 * | 7/2009 | Stincelli et al. | 273/392 |

OTHER PUBLICATIONS

Duelatron, Product Literature 1995.
Law Enforcement Targets, Inc., Product Literature, Jul. 8, 2003.
Law Enforcement Targets, Inc., Product Literature, Oct. 12, 2004.
Law Enforcement Targets, Inc., Product Literature, Jun. 26, 2007.
Metal Spinning Target, Inc., Dueling Trees, Jul. 8, 2003.
Mike Gibson Manufacturing, Dueling Tree, Jul. 8, 2003.
Outwest Mfg. Products, Product Literature, Jul. 8, 2003.
Porta Target, Product Literature, Circa 2000.
Shootrite, Tactical Training Target, published prior to Apr. 4, 2005.

* cited by examiner

TARGET SYSTEM

PRIORITY

The present application claims the benefit of U.S. Provisional Patent Application Ser. No. 61/433,513, filed Jan. 17, 2011, which is incorporated herein by reference in its entirety.

THE FIELD OF THE INVENTION

The present invention relates to targets used for target practice. More specifically, the present invention relates to target systems which can be readily modified to facilitate different target training exercises.

BACKGROUND

In order to maintain proficiency in the use of firearms, it is common for law enforcement officers, members of the military and sportsmen to engage in target practice. While many perceive target practice as simply a method for improving accuracy, it is important for law enforcement officers and the like to conduct target practice in scenarios which improve timing and the ability to make split-second decisions on whether or not to fire. Such split-second decisions can mean the difference between life and death both for the officer and the potential threat.

In order to properly train police officers, it is important that they develop both hand-eye coordination and that they also receive sensory stimulation which is associated with actual conditions, such as feedback as to whether a potential threat has been properly handled. It is important for law enforcement officers and the like to be able to see when a target has been hit properly.

Likewise, it is also desirable for a police officer to be forced to make split second decisions on whether or not to fire. If an officer is properly trained in making firing decisions, he or she will be more comfortable with his or her ability to make a split second decision and will be able to make decisions more accurately. This can lower the risk of an officer accidentally firing at a person who is not an actual threat or hesitating too long to shoot at a person who is endangering the life of the officer or others who are nearby.

One common type of target is a pop-up target. A pop-up target is typically disposed behind a shield and includes a target which can be made to stand generally vertical. When the target is hit by a bullet, the target will fall over, thereby providing a visual stimulus that the target has been hit. An arm often engages the target and lifts it back into a vertical position to allow further shooting. Other targets may use a spring to draw the target back to the upright position.

Another type of target is a shoot through target which has distinctive "kill zones." Such a target may provide a silhouette of a person and have cut-outs in areas where a hit would most likely be fatal (typically the head and parts of the chest). The officer often will not be able to advance until the target has been hit in the kill zone. Thus, the officer is placed under stress until he or she has properly hit the target in such a way that a real person would be incapacitated if so hit.

It is beneficial for the officer to receive prompt indication that he or she has appropriately hit the target. For example, shooting at a target and then retrieving the target to see where it has been hit is often less desirable than allowing the officer to see a visual response in the target itself immediately after the shot. Thus, for example, it is desirable if the officer can instantly know that he or she has hit the target in the desired "kill zone." If the officer does hit the target in the appropriate location, he or she can immediately move to the next target. If the officer misses, he or she can take additional shots until the goal has been met.

In order to maximize the benefit of training, it is often desirable to change the targets between each exercise. This prevents the officer from getting accustomed to the target layout and anticipating what will be presented. However, with many existing target designs, changing the targets can be time consuming and burdensome.

Thus there is a need for an improved target which allow for rapid change out of portions of the target to provide customization of a target course in very little time and without the need for tools, etc.

SUMMARY OF THE INVENTION

Embodiments of an improved target system and associated methods are disclosed below. According to some embodiments, the target system includes a blocking plate which may be positioned in a forward position to present a general target area for a shooter. One or more openings are formed in the blocking plate in areas where it may be desirable for the shooter to hit. At least one target is placed behind the opening(s) in the blocking plate. The target is movable when struck by a bullet to provide a visual indication that the target has been hit by the shooter. In such a manner, the shooter is provided with an immediate indication as to whether the shot was successful.

In accordance with one aspect of the invention, the target may be attached to the blocking plate or a structure positioned behind the blocking plate by a hinge mechanism to enable the target to pivot when hit by a bullet or other projectile. The hinge mechanism, in one embodiment of the invention, allows the target to be attached to and removed from the hinge mechanism without the use of tools. Tool less attachment of the targets to the hinge mechanism allows the target to be mounted on or in the hinge mechanism and removed therefrom in a matter of seconds, thereby facilitating the changing of target plates.

In accordance with another aspect of the invention, the hinge mechanism may include a hinge pin and a pair of hinge mounts that interact with one another. A portion of the hinge pin is configured to engage a shaped opening in the hinge mounts to allow rotation of the hinge pin a predetermined amount (e.g. 80-100 degrees or other ranges) while preventing further rotation of the target.

In accordance with another aspect of the invention, the hinge mechanism may include a hinge pin which is held within the hinge mounts by the target itself, and removal of the target enables the hinge pin to be removed from the hinge mounts.

In accordance with another aspect of the present invention, the hinge mechanism may include a hinge pin with an opening extending therethrough and sized to receive the target through the opening.

In accordance with another aspect of the present invention, the target is formed by a target plate, the target plate may have retaining tabs configured to engage the hinge pin to prevent the target plate from passing completely through the hinge pin.

In accordance with still another aspect of the invention, the retaining tabs of the target plate may be sized and positioned to be disposed adjacent the hinge mounts such that the restraining tabs limit movement of the hinge pin and thereby hold the hinge pin in the hinge mounts.

In accordance with yet another aspect of the invention, a plurality of targets having different visual characteristics may be included with the target system. The different targets may be mounted in the hinge pins to change the visual effect given to a shooter and thereby indicate whether or not the shooter is to shoot at a given target.

In accordance with still yet another aspect of the present invention, the plurality of targets may comprise targets having different mass to thereby allow the target to move appropriately in response to a given class of projectile, while minimizing damage to the target. Thus, for example, the target may be made from $\frac{1}{4}^{th}$ inch soft steel for being shot with a 22 caliber pistol, and be replaced with a ½ inch piece of hardened steel for being shot by a high powered rifle.

It will be appreciated that the present invention provides various aspects and different embodiments provide different advantages. Thus, it will be appreciated that each embodiment need not provide all aspects or advantages of the present invention while still falling within the general scope of the invention as set forth in the appended claims.

BRIEF DESCRIPTION OF THE DRAWINGS

Various embodiments and features of target systems are shown and described in reference to the following numbered drawings.

Figure 1:
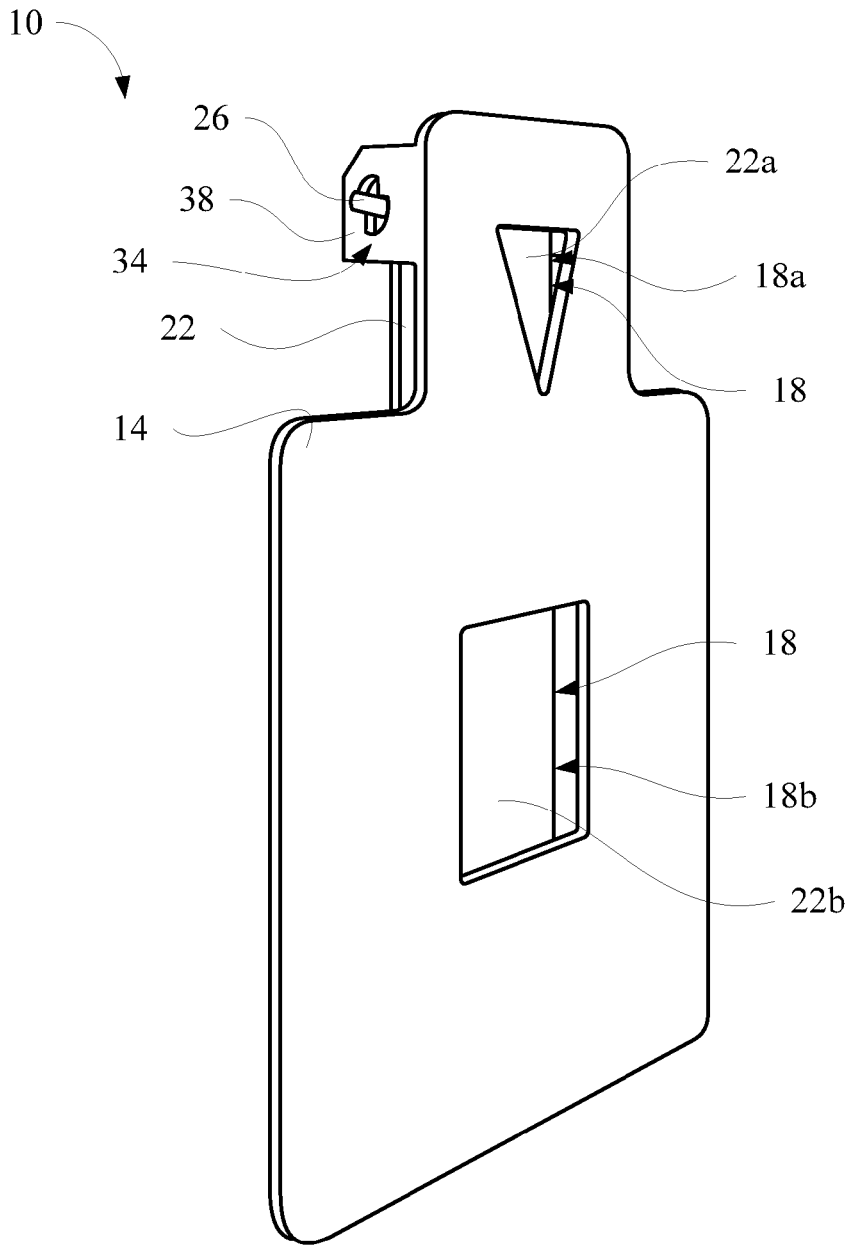
FIG. 1 shows a front, perspective view of an exemplary embodiment of a target system made in accordance with principles of the present invention.

It will be appreciated that the drawings are illustrative and not limiting of the scope of the invention which is defined by the appended claims. The embodiments shown accomplish various aspects of the invention. It is appreciated that it is not possible to clearly show each element and aspect of an invention in a single figure, and as such, multiple figures are presented to separately illustrate the various details of embodiments of target systems in greater clarity. Several aspects from different figures may be used in accordance with target systems in a single structure. Similarly, not every embodiment need accomplish all advantages of various embodiments of target systems.

DETAILED DESCRIPTION

Embodiments of target systems and associated methods as shown in the accompanying drawings, which include reference numerals referred to below, provide details for understanding and practice by one skilled in the art. The drawings and descriptions are exemplary of various aspects of target systems and associated methods and are not intended to narrow the scope of the appended claims.

Turning now to FIG. 1, a perspective view of a target system 10 is shown. The target system 10 includes a blocking plate 14. The blocking plate 14 may be of any particular shape. However, it may be preferred to have the blocking plate 14 to have a generally similar shape as the expected real life target associated with a particular tactical situation. Thus, as shown in FIG. 1, the blocking plate 14 is in the general silhouette of a person. However, other blocking plate shapes could be used. For example, if training to disable a vehicle, a blocking plate may be in the shape of a vehicle. If being used to train for hunting, the blocking plate may be generally in the shape of an animal.

The blocking plate 14 may include one or more openings 18 through which a bullet or other projectile can pass. As shown in FIG. 1, a first opening 18*a* is positioned to correlate with a person's head. This area, often referred to generally as a "kill zone," correlates to an area which an officer should shoot when trying to kill a perpetrator. A shot to the head will usually be disabling and, at a minimum, prevent the shooter from being able to threaten or injure the officer or third parties.

The second opening 18*b* is positioned at another kill zone, the area immediately around the heart. A perpetrator hit in the proper place in the chest will usually be killed or incapacitated. Thus, an officer engaging in target practice can shoot at the two kill zones on a target to ensure that he or she is able to take down a threat before the threat can injure the officer or others.

It will be appreciated that target openings on other targets may have different shapes or may be positioned in different locations relative to a blocking plate. For example, an infantryman in the army may train to disable a vehicle with his weapon. The blocking plate 14 may be in the shape of a truck and the openings 18 may correlate with the likely location of the driver's head, the gas tank or other locations in which the soldier should shoot. Likewise, if used for practice hunting, the blocking plate 14 may be in the form of an animal and the openings 18 placed in appropriate locations for the animal (typically the head and heart).

Disposed behind the openings 18 are targets 22 which are to be hit by the shooter. The targets 22 may typically be steel plates or comprised of some other similar or suitable material to be impacted by the bullet. Because it is generally desirable for the shooter to instantly recognize if he or she has hit the target 22, the targets are connected to a hinge mechanism 26. When the target 22 is hit, it will swing backwards and upwardly in response to the impact of the bullet. This allows the shooter to know instantly whether the kill zone has been hit. This may be important as a shooter may not be allowed to advance until a given number of hits are made to a kill zone. Thus, for example, a shooter may not be allowed to advance until he or she has had at least one shot strike the head target (22*a*) and two shots which strike the chest target (22*b*). The shooter is able to instantly tell if each shot hit the appropriate target 22 and when she can proceed to the next target.

As will be discussed in more detail below, the hinge mechanism 26 allows the target 22 to move, but may also limit movement to contain the "reset" time—i.e. the time between hitting the target and when the target is once again ready to be hit. This may be done by an interaction between a hinge pin 30 and a shaped opening 34 on hinge mounts 38.

One important aspect of a target system 10 such as that shown in FIG. 1, is the ability to change out the targets 22. While marksmanship is important, it is also desirable to require the officer, etc., to be forced to adapt to different situations and make split second decisions regarding whether or not to fire. If the same targets 22 are presented every time, the officer can anticipate how he or she is supposed to react to a given target, thereby allowing him or her to pre-decide the appropriate reaction (i.e. whether to fire and where to fire). Thus, it is desirable to routinely change the targets 22 so that the officer, etc., must make decisions when the target is presented. Targets with different colors or other visual identifiers may be used to indicate whether the officer, etc., should or should not shoot.

Additionally, it may also be desirable to change targets 22 in response to different types of ammunition being fired. For example, when firing a high powered rifle, it may be desirable to have a heavy plate of hardened steel as the target to minimize damage caused to the plate. However, if the shooter is firing a 0.22 caliber pistol, a very heavy plate will move little in response to the impact, thereby minimizing the ability of the shooter to confirm that he or she hit the proper location. Thus, it is desirable to be able to change out the targets 22 so that the target will respond appropriately when a particular caliber of bullet strikes the target. The present invention allows such changes to be made with very little effort and can avoid the need for tools altogether.

Figure 2A:
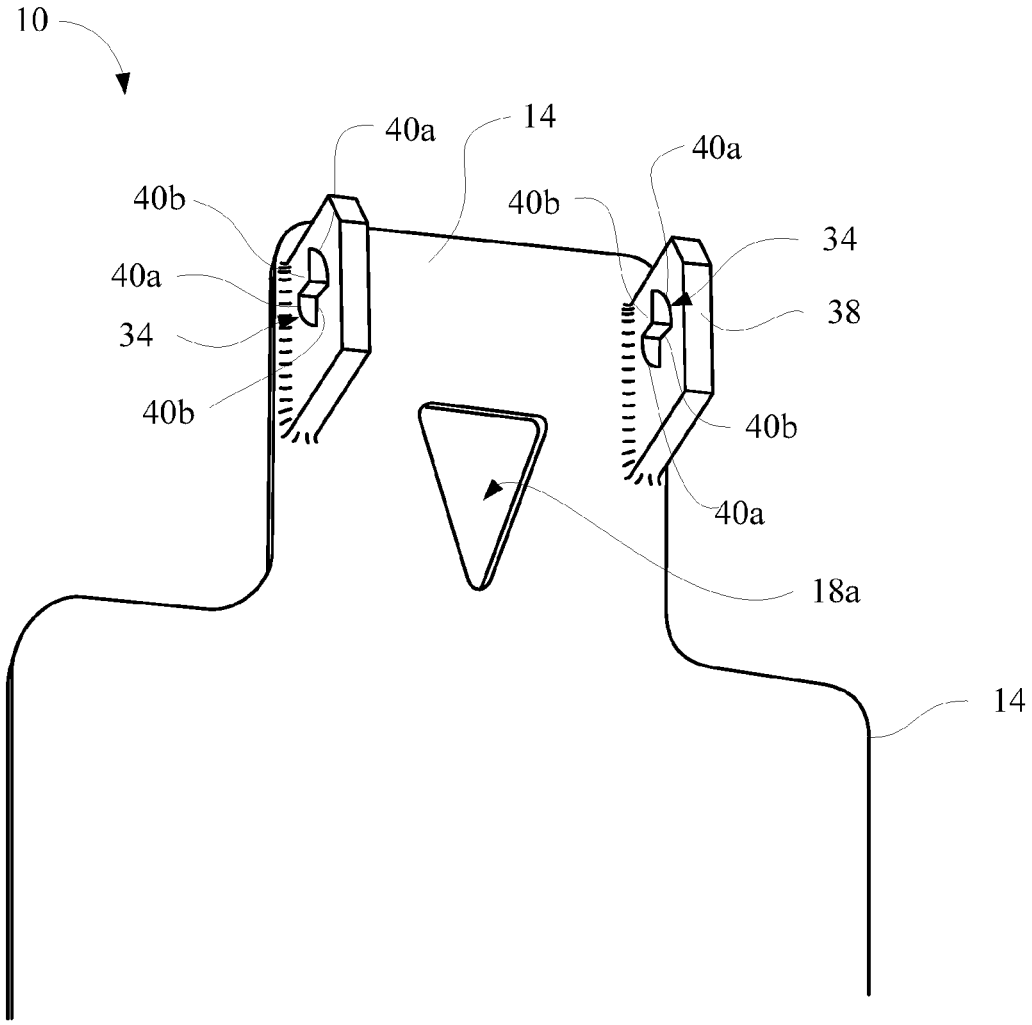
FIG. 2A shows a close-up view of a portion of the blocking plate and hinge mounts in accordance with the principles of the present invention with other structures in FIG. 1 removed.

FIG. 2A shows a close-up view of the upper portion of the blocking plate 14 and the hinge mounts 38 which may be attached to or formed integrally with the blocking plate 14. The associated hinge pin and target have been removed for clarity.

The hinge mounts 38 may be positioned adjacent to the opening 18*a* (typically above so that the target (not shown) hangs down behind the opening). Openings 34 are formed in the hinge mounts to receive the hinge pin (not show) and allow the hinge pin to rotate.

As shown in FIG. 2A, the openings 34 may be shaped to allow some rotation of the hinge pin, but to limit the extent of that rotation. Thus, the openings have first portions 40*a* which may be approximately quarter circles in which the hinge pin can rotate, and projections 40*b* for stopping rotation of the hinge pin. As shown in FIG. 2A the shape of the openings will limit rotation of the hinge pin to about 90 degrees. The shape could be modified to provide other desired amounts of rotation.

Figure 2B:
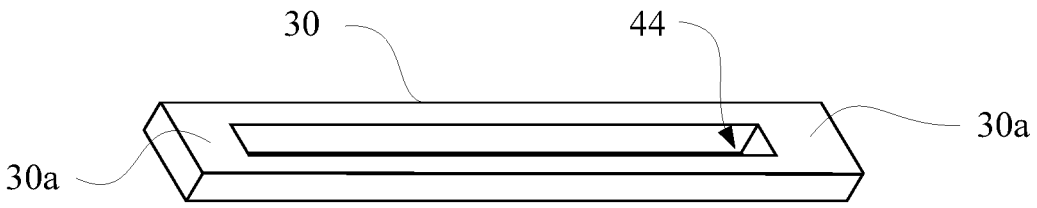
FIG. 2B shows a close-up view of a hinge pin shown in FIG. 1.

FIG. 2B shows a view of a hinge pin 30 in accordance with the principles of one embodiment of the present invention. The hinge pin 30 may have flattened ends 30*a* (and may be generally rectangular in cross-section) so as to cooperate with the shaped openings 34 (FIG. 2A) in the hinge mounts 38. However, it will be appreciated that the hinge pin 30 can be cylindrical or other shapes depending on the engagement with the hinge mounts 38, etc.

The hinge pin 30 includes an elongate opening 44 which extends into and, in the present embodiment, through the hinge pin 30. As will be explained in additional detail below, this allows the target or a portion thereof to be inserted into the hinge pin 30 without the use of tools.

Figure 2C:
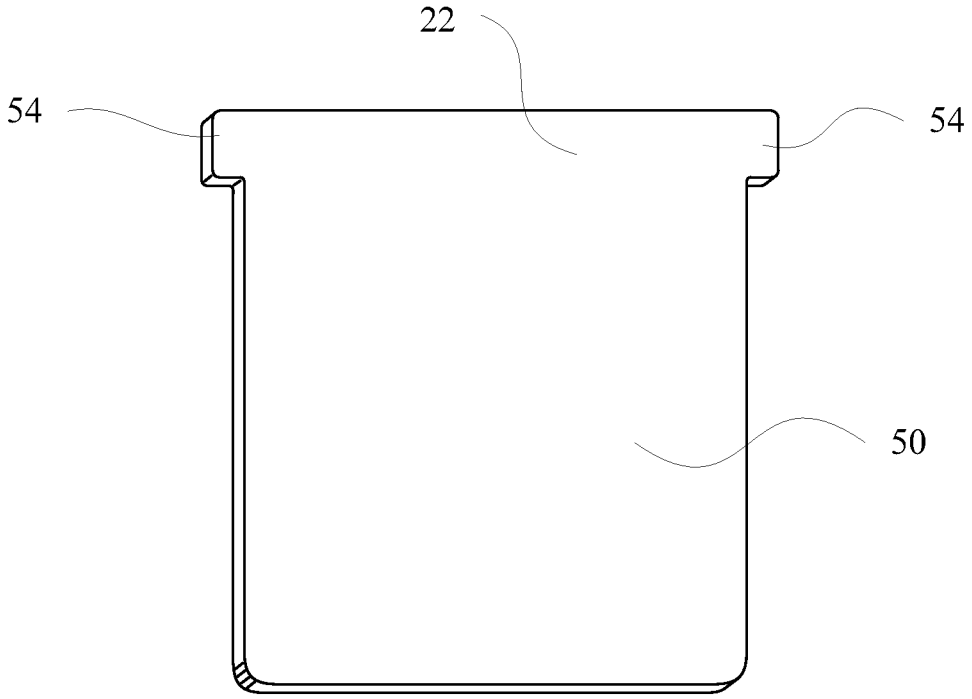
FIG. 2C shows a close-up view of a target as shown in FIG. 1.

Turning now to FIG. 2C, there is shown a close-up view of a target 22. The target includes a target plate or body 50 which can be inserted into the opening 44 in the hinge pin 30 (FIG. 2B). The target body 50 may extend below the hinge pin 30 when the hinge pin 30 is disposed in the hinge mounts 38 (FIG. 2A). To keep the target 22 from passing completely through the opening, retaining tabs 54 are disposed along a portion of the target 22 (typically at or near the top). Thus, the retaining tabs 54 keep the target 22 attached to the hinge pin 30 until it is desired to change the target 22. It will be appreciated that the retaining tabs 54 can be a wide variety of structures and can either keep the target 22 from passing through the opening 44, or may themselves engage the opening to hold the target 22 to the hinge pin 30.

Figure 3A:
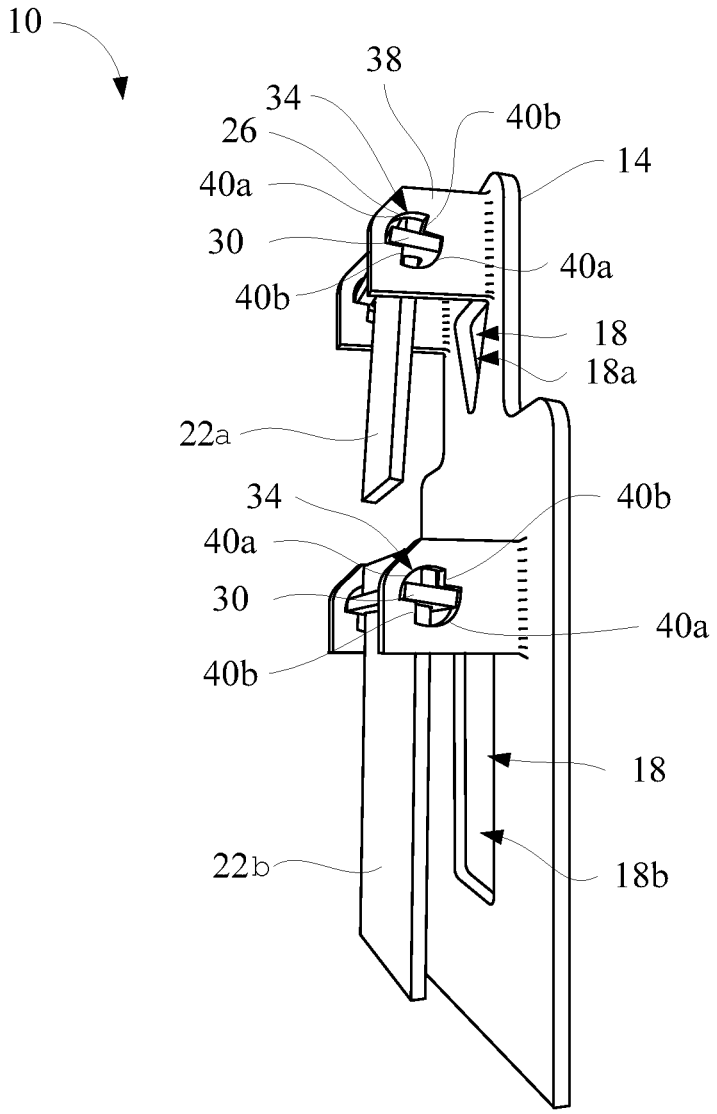
FIG. 3A shows a side view of the target system of FIG. 1.

Turning now to FIG. 3A, there is shown a side view of the target system 10 of FIG. 1. The target system 10 includes the blocking plate 14 and a plurality of openings 18 associated with desired kill zones. It will be appreciated that the openings 18 do not need to be completely contained by the blocking plate. Thus, for example, an opening 18 could merely be a cut-away portion extending in from one of the sides of the blocking plate 14. It will also be appreciated that a target system 10 may include only a single opening 18.

The targets 22 may be formed by pieces of metal (often steel) or other appropriate target material. In some instances it is desirable to have the projectile penetrate the target 22 to provide confirmation of a hit. Thus, softer materials such as plastics, wood, etc., may also be used.

The targets 22 are held in place by hinge mechanisms 26. The hinge mechanisms 26 are formed by hinge pins 30 which rotate in openings 34 in hinge mounts 38. As shown in FIGS. 2A and 3A the hinge mounts 38 may be formed integrally with or attached to (by welding or other means) the blocking plate 14. In other words, extensions can be formed into the blocking plate 14 and then bent rearwardly to form the hinge mounts 38, or the hinge mounts 38 can be formed separately and attached to the blocking plate 14.

While shown as being attached to the blocking plate 14, it will be appreciated that a support frame or other structure could also be used to hold the hinge mechanisms 26 and targets 22 behind the blocking plate 14 without them having to be attached thereto. The blocking plate 14 could also be attached to a common support frame as the hinge mechanisms 26 to hold all of the parts in relative proximity to one another.

It will be appreciated that the hinge pin 30 can be of a variety of shapes. For example, the end of the hinge pin 30 could be round and could rotate in a generally circular opening. However, in accordance with one aspect of the present invention, the end of the hinge pin 30 is generally rectangular and is mounted in an opening which may be rounded on two opposing approximate quarter circles 40*a* having inwardly extending projections 40*b*. In this configuration, the end of the hinge pin 30 is allowed to rotate approximately 90 degrees until its rotation is prevented by the projections 40*b*. This, in turn, allows the target 22 to be deflected adequately to clearly indicate that it has been hit, but forcing it to return quickly to its original orientation behind the openings 18 in the blocking plate 14. It also prevents the target 22 from rotating upwardly to the point where gravity holds it in contact with the back side or top of the blocking plate 14.

Figure 3B:
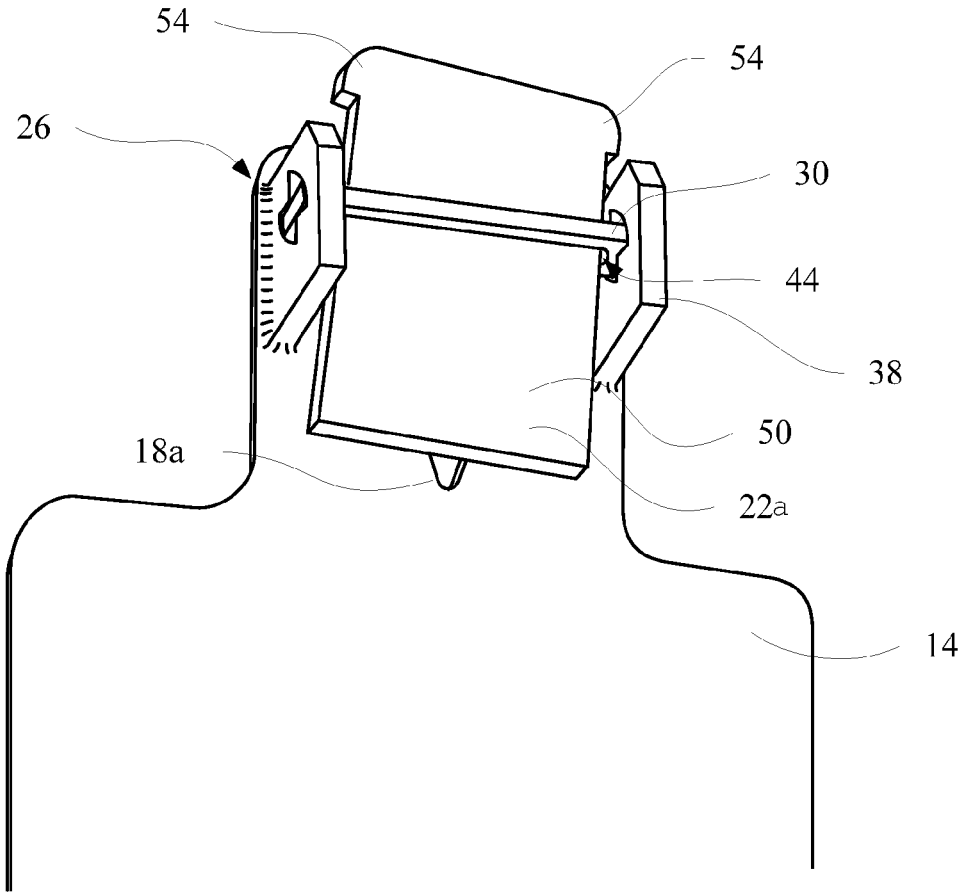
FIG. 3B shows a close-up view of an upper target plate of FIG. 1 being removed from the hinge pin in which it is mounted.

Turning now to FIG. 3B, there is shown a close-up, rear perspective view of the target system 10 looking at the upper target 22*a* and the hinge mechanism 26. In accordance with one aspect of the present invention, the hinge mechanism 26 is formed with a hinge pin 30 which has an opening 44 therein. According to one aspect, the opening 44 extends through the hinge pin 30. The target 22*a* is formed by a bullet impact plate 50 and one or more retaining tabs 54. At least a portion of the target plate 50 is sufficiently narrow to slide through the opening 44 in the hinge pin 30. The retaining tabs 54 or some thickened portion of the target plate 50, however, is larger than the dimensions of the opening 44 in the hinge pin 30 to prevent the target 22*a* from passing completely through the opening 44. In this manner, the target 22*a* is suspended adjacent opening 18*a* in blocking plate 14 by the hinge pin 30, and the hinge pin 30 will rotate wit the target 22*a* when the target is struck by a projectile. If the shaped openings 34 are used, the rotation of the hinge pin 30 will be limited by the hinge mounts 38.

It will be appreciated that in addition to the tabs 54 preventing the target 22 from passing through the opening 44, the tabs 54 could be made to engage the opening 44. Thus, the target 22 could also be suspended by the tabs 54 mounted in the opening 44 in the hinge pin 30.

One significant advantage of certain embodiments of the present invention is that the target plate 50 and thus the target 22 can be removed from the hinge pin 30 with very little effort. Rather than requiring tools, simply lifting or pushing the target 22 upwardly allows it to be drawn out of the opening 44 in the hinge pin 30. Thus, in a manner of one to two seconds one target 22 can be removed from the hinge pin 30 and a different target may be put in its place.

As was mentioned previously, it may be desirable to replace a target 22 depending on the type of projectile being fired at the target. A much heavier plate may be used for high caliber rifles than with a small pistol. In accordance with the present invention, this can be done in moments and without the need of tools.

Likewise, if a target 22 becomes damaged or is no longer of use, the plate can be removed virtually instantaneously without the use of tools. Thus, if the target 22 is being used for documentation (i.e. how many hits were recorded), the target 22 can be removed and replaced with the next target in a matter of seconds.

Additionally, the ability to replace the target 22 allows different visual indications to be used. For example, to judge an officer's ability to make quick, accurate decisions, an officer may be presented with ten target systems side by side and then instructed to only shoot red. The officer would then advance in front of each target and have to determine whether or not to shoot. The first target system may have two green targets 22, the second two red targets 22 and the third a green lower target 22*b* and red upper target 22*a*, followed by two target systems with green targets in both areas. As the officer moves through the training scenario in a timed manner, trainers can evaluate how quickly the officer is making decisions and how accurately both the decisions and the shooting are being made. If the officer needs additional training, in less than 1 minute, the trainer can change the locations of the red and green targets. When the officer again goes through the test, he or she must make decisions about whether to shoot and cannot rely on memory, for example, that target system numbers 1, 4 and 5 are no shoots, target system 2 is both and target system 3 is a head shot only.

One aspect of the present invention also shown in FIG. 3B is that the target 22 (either the retaining tabs 54 or the plate 50 itself) may be used to hold the hinge pin 30 in place. Removing the target 22 may allow the hinge pin 30 to be removed without tools, thereby facilitating removal of the hinge pin 30 if desired or necessary.

Figure 4:
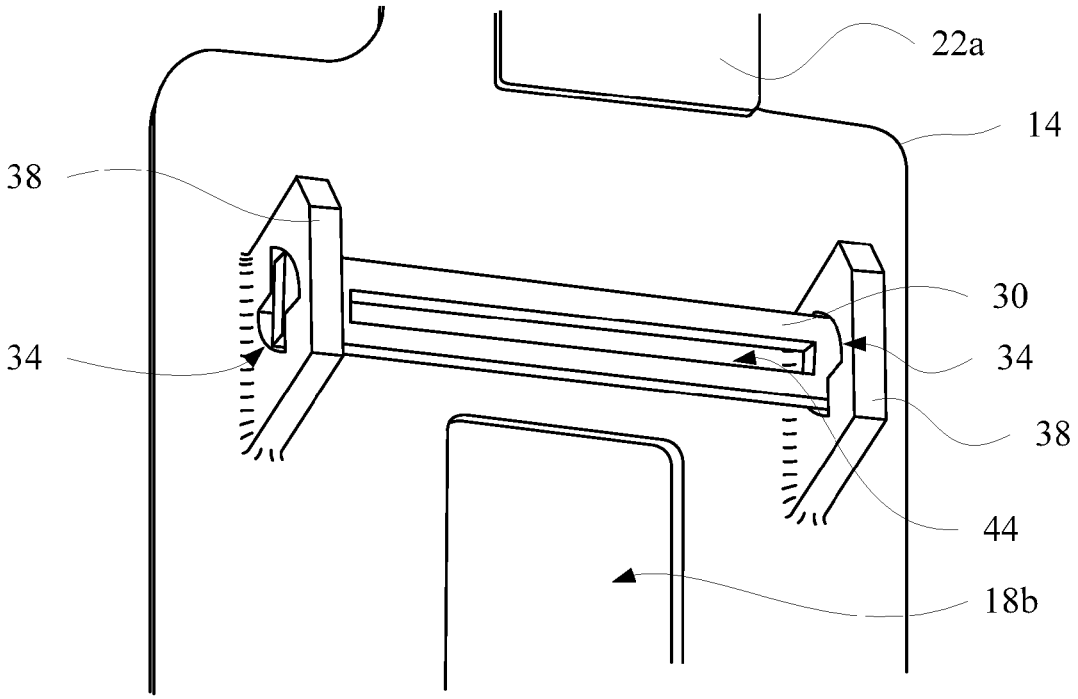
FIG. 4 shows a close-up view of a hinge pin and hinge mounts which form the hinge mechanism for a lower target plate.

Turning now to FIG. 4, there is shown a close-up view of the hinge pin 30 disposed in the hinge mounts 38 behind the blocking plate 14. The view in FIG. 4 more clearly shows the opening 44 in the hinge pin 30 into which the target 22 is slid for use. The opening 44 allows the target 22 to be quickly mounted or removed and thereby facilitates frequent changing of the target 22. This, in turn, increases the likelihood that trainers and the like will frequently modify the target systems 10 which are presented to officers and thereby avoid conditioning as to which targets 22 should be shot and which should not. It also makes repair and replacement much easier and avoids the situation where changes cannot be made because someone forgot to bring tools to the range.

Figure 5:
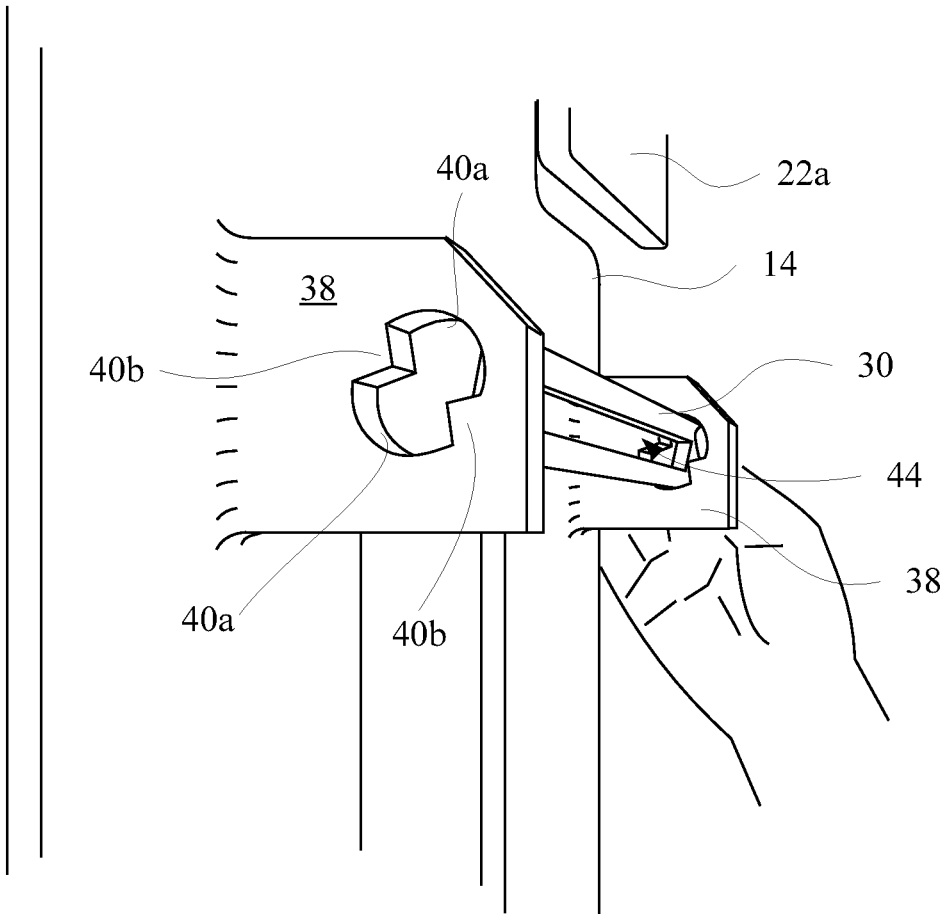
FIG. 5 shows a close-up view of the hinge pin of FIG. 4 being removed from the hinge mounts.

Turning now to FIG. 5, there is shown a perspective view of the hinge pin 30 being removed from the hinge mounts 38. Once the target 22 (not shown) is removed, the hinge pin 30 may be slid toward either of the hinge mounts 38 and removed and replaced if necessary. It also allows a person operating a shooting range to remove the hinge pins 30 and targets 38 quickly and easily to avoid corrosion, theft, vandalism or to service the target system 10.

Figure 6:
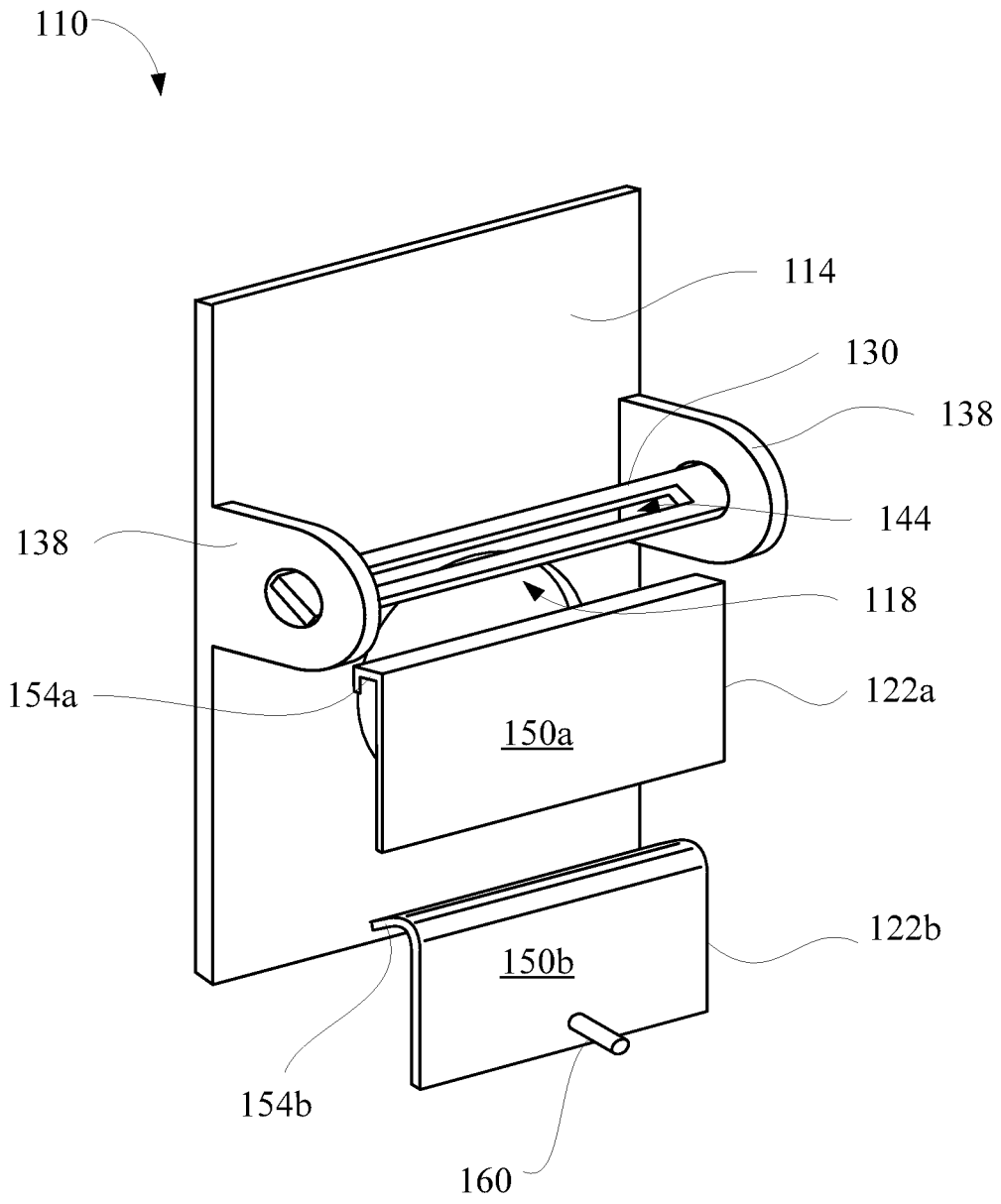
FIG. 6 shows an alternate configuration of a target plate formed in accordance with the present invention.

Turning now to FIG. 6, there is shown a view of an alternate embodiment of the present invention. The embodiment includes a target system 110 having a blocking plate 114 and two targets 122*a* and 122*b*. Target 122*a* shows a retaining tab 154*a* formed by a generally u-shaped fold of the target plate 150*a*. Either the target plate 150*a* or the opposing end of the retaining tab 154*a* can be inserted into the opening 144 in the hinge pin 130. The opening 144 in the hinge pin 130 may extend so that the target plate 150*a* or retaining tab 154*a* holds the hinge pin 130 in between the hinge mounts 138 when placed in the opening 144.

A second target 122*b* has a retaining tab 154*b* formed by a simple bend in the target plate 150*b* to prevent the target plate from passing through the opening 144 in the hinge pin 130. Unlike the prior figures, the hinge mounts 138 may have round holes. Thus, it may be desirable to have the retaining tabs 154*a*, 154*b*, or some other structure, engage the blocking plate 114 when a bullet passes through the opening 118 and impacts the target 122*a* or 122*b*. For example, a post, an arm, or the like 160 may extend generally perpendicularly away from the target plate 150*b* and contact the blocking plate 114 after the target 122*b* is hit by a projectile. It will be appreciated that the post 160 may be constructed to be various lengths, such that a longer post 160 will contact the backing plate 114 sooner than a shorter post 160 after the target 122*b* is hit by a projectile. Thus, a longer post 160 may allow the target 122*b* to be returned to its original position, i.e., in line with the opening 118, more quickly than if target plate 150*b* had a shorter post 160.

It will be appreciated that numerous changes may be made to the above-disclosed embodiments of target systems and associated methods without departing from the scope of the claims. The appended claims are intended to cover such modifications.

What is claimed is:

1. A target system, comprising:

a blocking plate having at least one opening formed therein;

a target disposed generally behind the blocking plate; and a hinge mechanism disposed behind the blocking plate for receiving the target, wherein the hinge mechanism comprises a hinge pin having an opening therethrough sized to receive at least a portion of the target;

wherein the target is removably attached to the hinge mechanism without the use of tools.

2. The target system of claim 1, wherein the target has at least one retaining tab, the retaining tab being shaped to prevent the target from passing completely through the opening.

3. The target system of claim 1, wherein the target system comprises a first target and a second target, the first target being visually distinguishable from the second target.

4. The target system of claim 1, wherein the target system comprises a first target having a first mass and a second target having a second mass, wherein the first mass is greater than the second mass.

5. The target system of claim 1, wherein the hinge mechanism comprises a shaped opening, and wherein the shaped opening engages the hinge pin in a manner that allows limited rotational movement of the target.

6. The target system of claim 5, wherein the shaped opening limits rotational movement of the target between about 80 degrees and 100 degrees.

7. The target system of claim 1, wherein the hinge mechanism comprises a pair of hinge mounts spaced a distance apart from each other for receiving the hinge pin, and the target has a maximum width, and wherein the distance between the hinge mounts is substantially the same as the maximum width of the target.

8. The target system of claim 7, wherein the target limits movement of the hinge pin when the at least a portion of the target is disposed in the opening extending through the hinge pin to thereby hold the hinge pin in the hinge mounts.

9. A bullet target comprising:

a blocking plate having an opening therethrough;

a target disposed generally behind the blocking plate and in line with the opening; and a hinge mechanism comprising:

a hinge pin having an opening therethrough for receiving the target; and hinge mounts for receiving the hinge pin;

wherein the target is removably attached to the hinge mechanism without the use of tools.

10. The bullet target of claim 9, wherein the hinge mounts comprise an opening for receiving the hinge pin.

11. The bullet target of claim 10, wherein the opening is comprised of at least one portion having an approximate quarter circle shape in which the hinge pin can rotate.

12. The bullet target of claim 11, wherein the approximate quarter circle shape limits the rotational movement of the hinge pin between about 80 degrees and 100 degrees.

13. The bullet target of claim 9, wherein the blocking plate comprises a plurality of openings.

14. The bullet target of claim 13, wherein the blocking plate has a plurality of sides, and wherein at least one of the opening of the plurality of openings comprises a cut-away portion extending in from one of the sides of the plurality of sides of the blocking plate.

15. The bullet target of claim 9, wherein the hinge pin is removably attachable to the hinge mounts without the use of tools.

16. The bullet target of claim 15, wherein the target limits the movement of the hinge pin relative to the hinge mounts when the target is received by the opening in the hinge pin.

17. A method of manufacturing a modifiable target system, the method comprising the steps of:

selecting a blocking plate having an opening therethrough;

disposing a hinge mechanism for receiving a target behind the blocking plate; and selectively attaching a first target or a second target to the hinge mechanism such that either the first target or the second target is substantially behind the blocking plate and in general alignment with the opening;

wherein the hinge mechanism comprises a hinge pin for receiving the first target and the second target and at least one hinge mount having a shaped opening, and wherein the shaped opening engages the hinge pin in a manner that allows limited rotational movement of the first target and the second target; and wherein selective attachment of the first target or the second target to the hinge mechanism does not require the use of tools.

18. The method according to claim 17, wherein the first target is visually distinguishable from the second target.

19. The method according to claim 17, wherein the first target has a mass that is greater than the second target.

* * * * *